United States Patent [19]

Held

[11] Patent Number: 4,987,397

[45] Date of Patent: Jan. 22, 1991

[54] ELECTROMAGNETIC PROTECTIVE SWITCHING DEVICE

[75] Inventor: Kurt Held, Amberg, Fed. Rep. of Germany

[73] Assignee: Siemens Aktiengesellschaft, Berlin and Munich, Fed. Rep. of Germany

[21] Appl. No.: 398,655

[22] Filed: Aug. 25, 1989

[30] Foreign Application Priority Data

Aug. 29, 1988 [DE] Fed. Rep. of Germany ... 8810908[U]

[51] Int. Cl.[5] ..... H01H 3/60; H01H 67/02

[52] U.S. Cl. ..... 335/131; 335/193

[58] Field of Search ..... 335/131, 132, 193; 338/131, 132, 193

[56] References Cited

U.S. PATENT DOCUMENTS

| | | | |
|---|---|---|---|
| 3,872,952 | 3/1975 | Kondo et al. | 335/132 |
| 4,318,065 | 3/1982 | Harbauer | 335/17 |
| 4,437,020 | 3/1984 | Schroether | 307/135 |
| 4,503,409 | 3/1985 | Lerude et al. | 335/132 |

FOREIGN PATENT DOCUMENTS

| | | |
|---|---|---|
| 1166895 | 4/1964 | Fed. Rep. of Germany . |
| 1296250 | 5/1969 | Fed. Rep. of Germany . |
| 1301393 | 8/1969 | Fed. Rep. of Germany . |
| 1690427 | 7/1971 | Fed. Rep. of Germany . |
| 2027136 | 9/1972 | Fed. Rep. of Germany . |
| 2948959 | 1/1983 | Fed. Rep. of Germany . |
| 3105117 | 10/1985 | Fed. Rep. of Germany . |

*Primary Examiner*—Steven L. Stephan
*Assistant Examiner*—Nilay H. Vyas
*Attorney, Agent, or Firm*—Kenyon & Kenyon

[57] ABSTRACT

An electromagnetic switching device having a magnet system with a magnet yoke and armature, this armature being connected to a contact carrier, which is movably guided in the housing of the switching device and has switching contacts lying one behind the other at right angles to the actuating direction. Together with stationary contacts, these switching contacts form make or break contacts, with supporting or locking stops being provided for switching contacts in the contact carrier. The contact carriers are guided with clearance in the housing, so that a tilting is possible. With regard to this tilting motion, the free path, that is the path which is required from the point where all break contacts are disengaged up to the point where all make contact are brought into contact, must be cut off at the last disengaging break contact. To keep this free path relatively long, the stops are arranged in the contact bridge carrier in a staggered manner.

4 Claims, 2 Drawing Sheets

ELECTROMAGNETIC PROTECTIVE SWITCHING DEVICE

FIELD OF THE INVENTION

The invention relates to an electromagnetic switching device having a magnet system with a magnet yoke and armature. This armature is connected to a contact bridge carrier, which is movably guided in the housing of the switching device and features switching contacts that lie at right angles to the actuating direction. Together with stationary contacts, these switching contacts form make or break contacts, and supporting or locking stops are provided for the switching contacts in the contact bridge carrier.

BACKGROUND OF THE INVENTION

An electromagnetic switching device having a magnet system with a magnet yoke and armature is shown, for example, in DE-AS No. 2 027 136. In such switching devices, the so-called "free path" is of special interest. The free path is that path which must be passed through from the point where the break contact is disengaged up to the point where the make contact is brought into contact. The free path is dependent on the tolerances relating to the guidance of the contact bridge carrier in the housing of the switching device. This is especially true when the break contacts are mounted on the corners of the contact carrier which are the furthest from the driving magnets. Here, a relatively greater loss of free path results due to the unavoidable clearance of the contact carrier within the interrupter chamber. This needs to be considered when dimensioning the free path.

There is thus a need for a switching device in which the free path can be established independently of tolerances relating to the guidance of the contact carrier in the housing of the switching device.

SUMMARY OF THE INVENTION

This and other needs are achieved in a switching device according to the present invention by arranging stops in a contact bridge carrier in a staggered manner so that the outer stops contact the switching contacts before the middle stops when the contact bridge carrier is moved in an actuating direction. When the stops are placed in a staggered arrangement that is diagonal to the actuating direction, then an attraction force curve is better adapted to the power requirement curve, so that the magnet system can be provided with a weaker dimensioning. The stops can be formed relatively easily, when they are configured as the front end surfaces in window-shaped openings of the contact bridge carrier, in which contact bridges are arranged.

With respect to adapting the attraction force curve of the magnet to the power requirement curve, an embodiment of the invention provides two rows of window-shaped openings which lie behind one another in the direction of closing and contain break or make bridges. The front end surfaces for the break bridges are arranged in the top row in a staggered manner, while the front end surfaces for the make bridges are situated in one plane.

DETAILED DESCRIPTION

Figure 1:
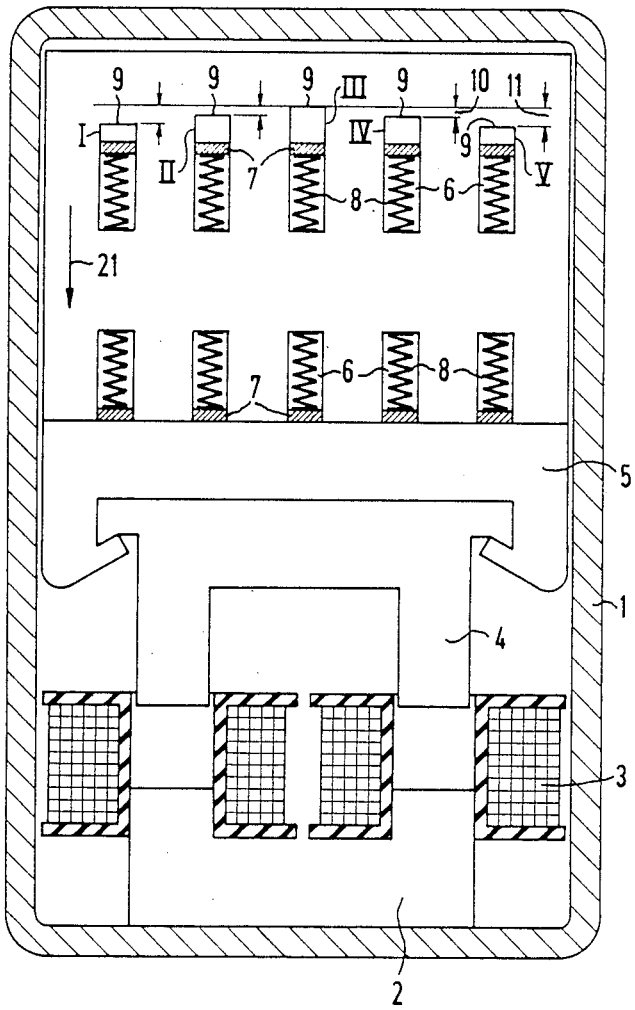
FIG. 1 shows a partially cross-sectional view of an electromagnetic switching device constructed in accordance with an embodiment of the present invention.

An electromagnetic protection switching device is shown in FIG. 1. This device has a stationary magnet section 2 constructed as a magnet yoke in housing 1 of the switching device and which is surrounded by an operating coil 3. An armature 4 of the switching device is coupled to a contact carrier which, in the illustrated embodiment, is a contact bridge carrier 5. The contact bridge carrier 5 has a window 6, in which contact bridges 7 are supported by contact pressure springs 8. Together with stationary contacts (not shown in greater detail), the upper contact bridges 7 form break contacts, while the lower contact bridges 7, provided in the bottom row, form make contacts with further stationary contacts. That is to say the contacts associated with the upper contact bridges are in the position shown making contact with opposing fixed contacts (not shown). Because of this there is a gap between each bridge 7 and the front end surfaces 9 of the windows. The spring 8 holds the contacts together with the fixed contacts, in effect, acting as stops.

As depicted in FIG. 1, front end surfaces 9 in the window-shaped openings 6 of the contact bridge carrier 5 are arranged in a staggered manner. As can be seen in FIG. 1, the front end surfaces 9 are staggered in the actuating direction 21 from the middle to the edges of the housing. This means in the normal case, when the contact bridge carrier 5 does not tilt, the outer contact bridges 7 (in windows I and V) are engaged by the end surfaces 9 before the inner contact bridges (in windows II, III, and IV) are engaged by the front end surfaces 9. This causes the associated contacts for windows I and V to break first. Further, the contact bridges 7 associated with windows II and IV will be disengaged, when the magnet is activated, i.e. goes from the "OFF" to "ON" condition, before the middle contact bridge 7 in window III, due to the staggered arrangement. The displacement of the front end surfaces 9 of the windows (II and IV) adjacent to the middle window (III) is denoted with 10, and that of the outer windows (I, V) with 11.

Figure 2:
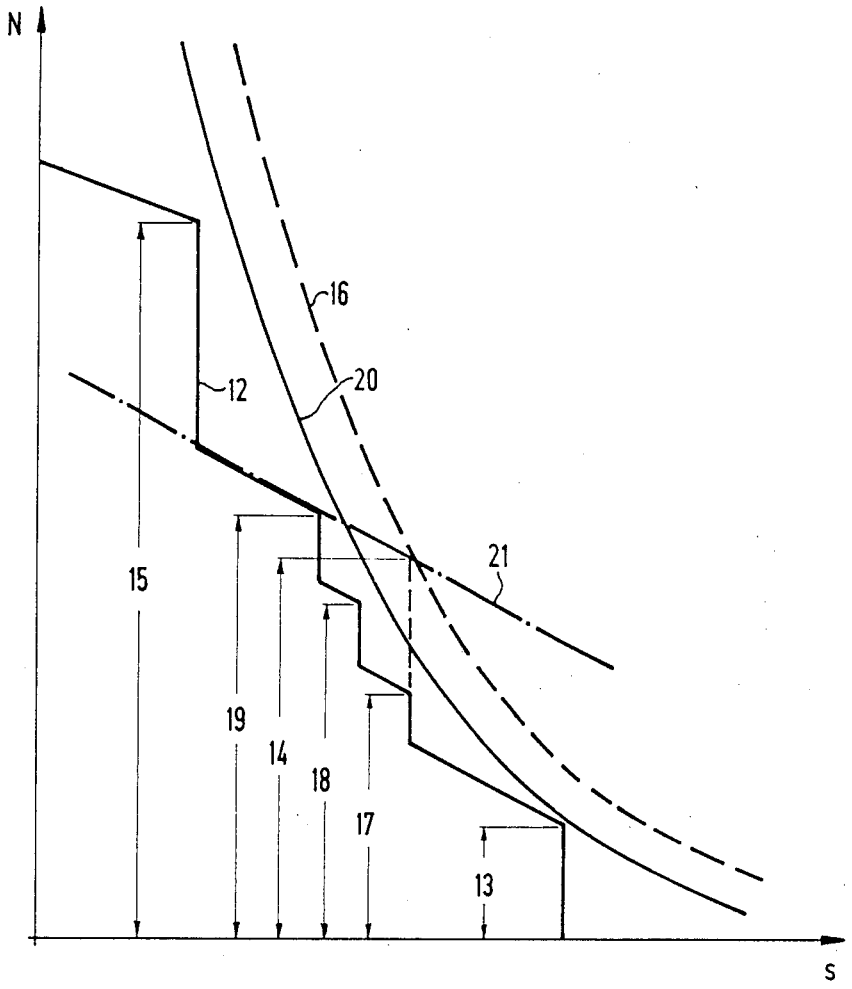
FIG. 2 illustrates the progression of the force required relative to the attraction force curve of the magnet.

In FIG. 2, the force 12 required to move the contact bridge carrier 5 is plotted in newtons (N) as a function of the air gap, that is of the path (S) of the armature. The segment 13 corresponds to the force in the "OFF" position. According to a certain stroke which occurs when the break contacts are opened, backpressure force is increased by the amount of the contact pressure force of the break contacts, because the fixed break contacts no longer act against the force of their return springs (dot-dash line 21), i.e., no longer act as stops for the movable contacts. If, in order to attain a longer free path, the displacement of all the windows were to be arranged above the front end surfaces 9, this would necessitate a power requirement corresponding to the segment 14. Accordingly, an attraction force curve 16 would be required (indicated with a dotted line) that lies above the point on the graph corresponding to the segment 14.

As a result of the staggered arrangement of the front end surfaces 9, a full-line progression results for the segments 17, 18 and 19. The force represented by segment 17 is present after both break contacts of the outer conducting paths I and V are opened; the force represented by segment 18 is present after the break contacts of the conducting paths II and IV are also opened; and the force represented by segment 19 is present when the break contact of the middle conducting path III is disengaged. By this means, an attraction force curve 20 can be selected which runs considerably below the attraction force curve 16, so that the magnet system can be provided with a weaker dimensioning.

The force requirement indicated in the diagram of FIG. 2 as the segment 15 corresponds to the force requirement when the make contacts are closed. Thus, without incurring constructional expenses, it is possible to compensate for the loss of free path, given the same attraction force curve, by arranging the stops according to the invention using the varying, staggered clearance of the contact bridge carrier 5.

What is claimed is:

1. An electromagnetic switching device comprising:

a housing;

a magnet system with a magnet yoke and an armature;

a contact bridge carrier coupled to said armature said contact bridge carrier being movably guided in the housing, and having a central longitudinal axis parallel to an actuating direction in which the carrier moves;

switching contacts carried by said contact bridge carrier and which are arranged at right angles to said actuating direction, said switching contacts forming make or break contacts; and outer and middle stops for the switching contacts in the contact bridge carrier, said outer stops being symmetrically arrayed about said central longitudinal axis, said outer and middle stops having a varying dimension as measured along the longitudinal axis such that the outer stops contact the switching contacts before the middle stops when the contact bridge carrier is moved in the actuating direction.

2. The switching device of claim 1, wherein the stops are arranged so that their dimension as measured along a direction parallel said longitudinal axis increases from the outer stops to the inner stops.

3. The switching device of claim 2, wherein the contact bridge carrier has window-shaped openings and further including contact bridges received in said windows, on which contact bridges said switch contacts are arranged and wherein the outer and middle stops are front end surfaces of the window-shaped openings.

4. The switching device of claim 3, wherein said contact bridge carrier has top and bottom rows of the window-shaped openings which lie one behind the other in the actuating direction and said contact bridges are make or break bridges, with the front end surfaces for the break bridges being arranged in the top row in a staggered manner, and the front end surfaces for the make bridges are situated in a single plane in the bottom row.

* * * * *